United States Patent [19]

Sinclair, Jr.

[11] Patent Number: 4,774,902

[45] Date of Patent: Oct. 4, 1988

[54] MID-PLANING HULL

[75] Inventor: Thomas L. Sinclair, Jr., Honolulu, Hi.

[73] Assignee: Sinclair & Associates, Inc., Honolulu, Hi.

[21] Appl. No.: 842,741

[22] Filed: Mar. 3, 1986

Related U.S. Application Data

[63] Continuation of Ser. No. 620,691, Jun. 14, 1984, abandoned.

[51] Int. Cl.[4] ..... B63B 1/18

[52] U.S. Cl. ..... 114/56; 114/271

[58] Field of Search ..... 114/56, 57, 271

[56] References Cited

U.S. PATENT DOCUMENTS 2,288,490 6/1942 Scott-Paine ..... 114/271

3,140,686 7/1964 Olivotti ..... 114/56

4,083,320 4/1978 Yost ..... 114/56

4,193,370 3/1980 Schoell ..... 114/56

FOREIGN PATENT DOCUMENTS 809325 2/1959 United Kingdom ..... 114/56

*Primary Examiner*—Sherman D. Basinger

*Assistant Examiner*—Edwin L. Swinehart

[57] ABSTRACT

A mid-planing hull for a fast, sea-going vessel in which the centers of buoyancy, gravity, and hydrodynamic lift at planing speeds substantially coincide amidships. In a preferred embodiment, the hull includes a full forefoot of conically developed forward sections, a straight and level keel in a vee-bottom of constant deadrise, with planing surfaces distinctly decreasing in area in the afterbody to trailing edges at the stern.

6 Claims, 2 Drawing Sheets

MID-PLANING HULL

This application is a continuation of application Ser. No. 620,691, filed June 14, 1984, now abandoned.

BACKGROUND OF THE INVENTION

The present invention relates to a hull capable of performance in a combination of speed and seakeeping heretofore found separately in displacement and planing hull types. The two qualities have always been difficult to combine because they depend on decidedly different hull forms.

The seakeeping characteristics of displacement hulls are well known. They are most evident in the classic lines of traditional sailing vessels with graceful curvature fore and aft to move easily under sail through the water and follow the waves. Those lines are little changed in the ocean-going ships of today, with their pointed bows, round bilges, rounded sterns, and amidships balance to ride as level as possible in meeting seas under all weather conditions.

More recently, hull speed has been increased by use of a very different hull form from that of displacement vessels, enabling such planing hulls to rise bodily towards the water's surface and move at higher speed because of less water resistance. Typically, planing hulls have sharp-cornered chines, flat bottom surfaces aft, and square transoms. For the sake of speed, they have given up some of the seakindly configuration of their predecessors, tending in a seaway to leap from the crest of each wave and to slam violently into the next.

The development of fast planing hulls began with the design of racing hydroplanes in the early 1900s, and they set the style for all speed boats with wide, flat planing surfaces aft. Morever, powerboats have been inclined to settle by the stern as they pick up speed; and that tendency is often aggravated into a bad squat as a fast boat rises up to plane. A typical planing hull then assumes an ungainly attitude, with its bow riding well up out of the water at high speed, an attitude safely maintained only in calm water.

Numerous inventions over the years have tried to correct the problem of poor planing trim, usually by adding some leveling or stabilizing device. For example, Weiland's U.S. Pat. No. 988,437, dated July 18, 1911, and Prosser's U.S. Pat. No. 1,075,726, dated Oct. 14, 1913, both attached something like water skis to either side of a small, narrow boat. More recent attempts to improve trim were in having slightly concave bottom lines aft to keep the stern up by deflecting passing water downward, as disclosed in the Burgess U.S. Pat. No. 2,185,430, dated Jan. 2, 1940, and the Troyer U.S. Pat. No. 2,342,707, dated Feb. 29, 1944.

The introduction of fiberglass boatbuilding in the 1950s boosted mass production of planing hulls by the use of molds to provide hulls in almost any shape or form. Since then, extruded panels, steps, and chine lips have become common in multiple horizontal surfaces added to the basic vee-bottom. In what has been popularly accepted as modern styling, the extra angles and curves seem to create an illusion of speed, but speed is actually reduced by the increase in wetted surface. Improvement in trim may be claimed or implied, but there has actually been little change in planing performance. Examples of such modern design in fiberglass planing hulls include those disclosed in the Becker U.S. Pat. No. 2,634,698, dated Apr. 14, 1953; the Canazzi U.S. Pat. No. 2,980,924, dated Apr. 25, 1961; and the Schoell U.S. Pat. No. 4,193,370, dated Mar. 18, 1980.

A significant improvement in planing hull design occurred in 1959 when the so-called "deep vee" for ocean racing put a definite dihedral or deadrise angle in a planing hull bottom. The change became popular and was widely copied as it greatly improved directional stability for open ocean operation. However, the improvement had little efect on planing aspect or trim and thus did not minimize slamming or pounding by the forward portion of the hull. The latest models are still characterized by hard chines, vee-bottoms, and broad transoms to carry maximum planing surfaces farthest aft; and planing hulls still ride on their afterbodies, being notoriously rough in any waves.

While there has been no fundamental change in planing hull lines to achieve a desirable minimum angle of trim, trim tabs are commonly installed at the transom to offset an extreme squat. Similar to the former use of wedge-shaped blocks under the transom to force the water down and push the stern up toward a more horizontal position, external contrivances like trim tabs have only a limited effect, as they function at some expense of economy or speed. Any such projections from the hull proper, whether in attachments or extrusions, will reduce speed by adding to wetted surface and parasitic drag. Reverse curves or warped planes have the same adverse effect by increasing the area of skin friction and distorting the free flow of water past the hull.

Riding trim is largely a matter of innate balance, something primarily in hull form not very well managed by simply adding to or changing hull surfaces. A slow and well balanced displacement vessel accepts sea conditions most agreeably without pounding or slamming; but a fast hull, riding on her after planes with a high bow, can only meet the waves with violent impact.

SUMMARY OF THE INVENTION

Two vessels that admirably exemplify the respective qualities of seakeeping and speed combined in this invention are the Hawaiian Sampan and the Navy Patrol Torpedo boat. The two hull types are strikingly similar in having a fairly deep and sharp forefoot, hard chines, vee-bottom, and transom stern; but a difference in their underbodies aft clearly distinguishes their characteristic performance. The Sampan has an upward run of her underwater lines aft to the stern; while the PT has chines and buttocks lines that run parallel with the keel straight aft to the transom.

The Sampan is a traditional, sturdy vessel of displacement type, able to maintain little more than ten knots, but very seakindly. Being almost perfectly balanced with buoyancy and weight amidships, it rides the waves on a fairly level keel as bow and stern successively rise and fall in no more than half the vessel's length.

The typical PT Boat is a lightweight planing hull, capable of more than forty knots when planing, but rough riding in a seaway. The bow of the PT Boat at speed inclines up and the hull is lifted farther out of the water to ride on her after planing surfaces. Coming off a large wave at speed, the airborne bow of an 80-foot PT will slam down into the next wave, often with such force as to bring the vessel momentarily to a shuddering stop.

The principal object of the present invention is to improve seagoing performance by combining, as best possible, the seakindly character of a Sampan and the planing speed of a PT Boat, enabling the vessel to drive through the crest of a wave, and then coast down the wave slope at speed with little change in level of trim. The improvement is accomplished by embodying the balance of underwater volume in the Sampan for seakeeping and the parallel buttocks of the PT boat bottom for speed. This combination provides a more level planing trim and tends to reduce both slamming or pounding by the bow and squatting by the stern. That balance in the hull of the present invention is derived from the marriage of forward presentation with planing surfaces to locate the centers of buoyancy, gravity, and lift amidships rather than at the extreme stern.

For better seakeeping at speed, the present invention more specifically includes a bow portion that will drive through the waves and is less susceptible to being tossed high and plunging precipitously down. The forebody, having a sharp entry at the stem and full-bodied sections under the bow, provides buoyancy forward to carry the center of gravity more amidships and also to cushion the impact of oncoming waves.

To improve speed in seagoing, the present invention provides lift amidships by planing surfaces that taper aft to be no more than trailing edges, and the chine lines converging aft toward the keel to at least half of their maximum beam amidships, lessening both wetted surface and body drag.

Manueverability is improved by the more streamlined form overall that allows better directional stability, smaller turning circle, and banking on high speed turns without slewing by the stern.

Efficiency is improved by hull lines designed to provide better trim for better utilization of propulsion thrust to gain more lift.

The instant invention finds an exceptional fore and aft balance in a surprisingly simple modification of underwater lines that enables a vessel to plane on her midsection. The convex forward sections are not only shaped to lessen the severity of wave impact but streamlined to improve speed. More subtly, but very definitely, they enhance the effectiveness of planing lift amidships and trim at the stern. The resultant seagoing balance is obtained with smooth and clean planing hull lines without any need for any attachments, extrusions, or concave surfaces. And the advantages in more stable riding, improved speed, and better handling in rough seas have been verified in prototype model tests.

While this invention has particular application to off-shore patrol and fishing vessels in the range of eighty feet in overall length, it may generally be applied to smaller craft that aspire to meet rough water conditions and to larger vessels in size up to and over 250 feet in length where a semi-planing condition can improve their speed. The preferred embodiment shows the lines of an eighty-foot vessel with a length-beam ratio of 4:1; but larger vessels may have a normal proportion up to 7:1, and smaller craft where the usual ratio may go as low as 3:1. The present invention is not limited to the particular embodiment shown in the drawings or described in the foregoing specification, and modification of details can readily be considered by those skilled in the art without departing from the invention as defined in the claims.

DESCRIPTION OF THE PREFERRED EMBODIMENT

The hull structure of the present invention may be more readily understood by reference to the drawings. Since hull performance is primarily a function of the underwater lines, particular attention is given to the underbody. The topsides may be conventional except where the hull sides toe in downwardly as they go aft to form an unconventional transom that is broad at the deck and narrow below the waterline.

Figure 2:
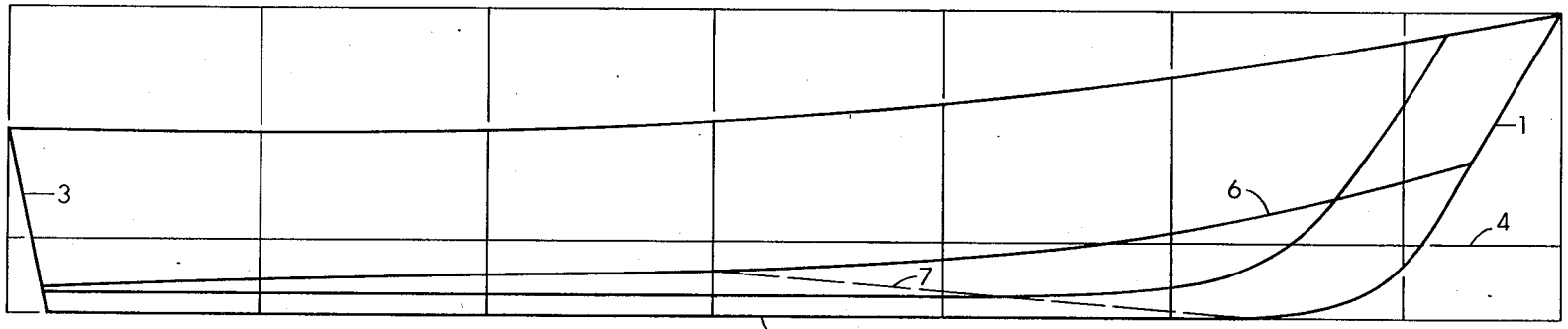
FIG. 2 is a profile view of the hull of FIG. 1.
Figure 3:
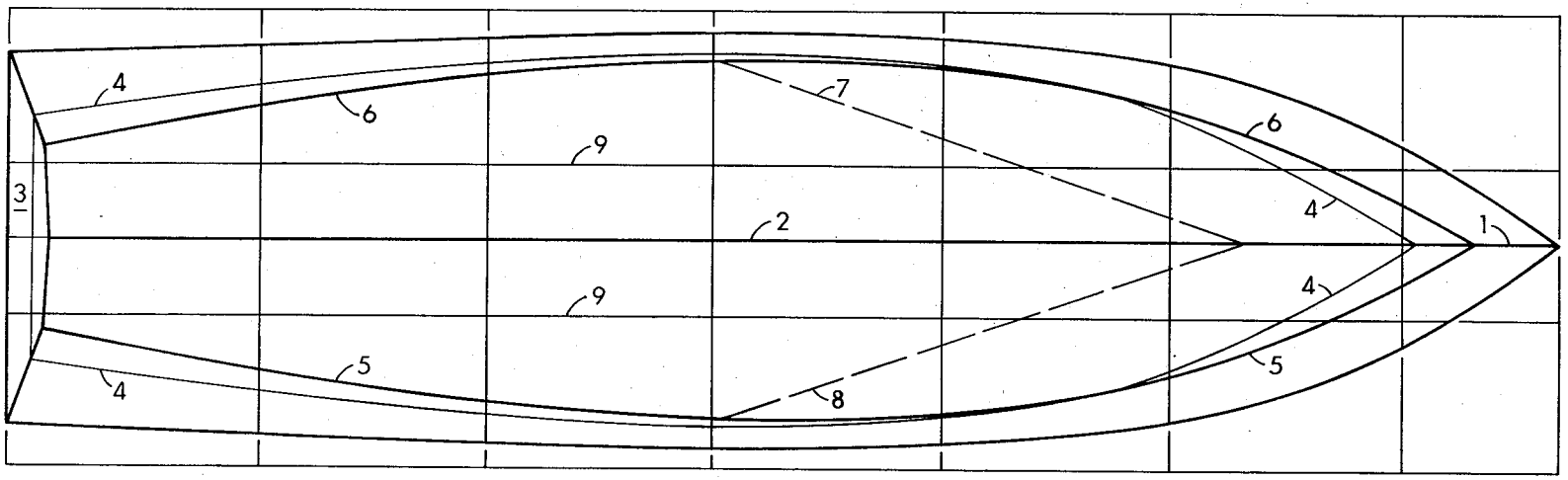
FIG. 3 is a plan view of the hull of FIG. 1.

As shown in FIGS. 2 and 3, a raked stem (1) at the bow goes deep before it curves into the keel (2), which runs straight and level aft to the transom (3) and parallel to the designed waterline (4). The two chines (5) and (6), outlining respectively the bottom to port and to starboard, begin forward at a point more than halfway up on the stem (1) to angle out and down to either side befor curving back to run nearly parallel to each other and the keel (2) amidships. Thereafter they continue to the stern by converging toward the keel while remaining in the two planes of the vee-bottom.

The two dashed lines (7 and 8) shown in both profile FIG. 2 and in plan FIG. 3, angling straight out to either side from forward on the keel to aft at the chines, mark the joint along which the conically developed forward surfaces flow smoothly or "fair" into the flat planing surfaces going aft. In plan view, the forward portion of the planing bottom is triangular in area before its two planes are narrowed toward the stern by the converging chines.

Figure 4:
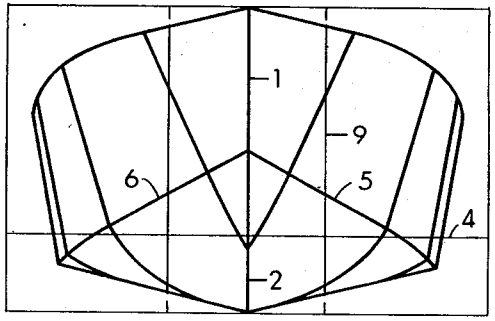
FIG. 4 is a forebody view of the hull of FIG. 1 through section lines at various forward stations.
Figure 5:
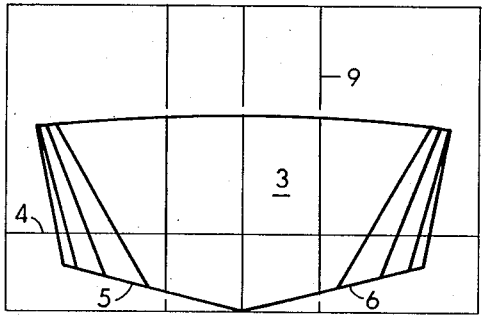
FIG. 5 is an afterbody view of the hull of FIG. 1 through section lines at various after stations.

FIG. 4 shows the corresponding port and starboard conical development of the convex forward sections below the chines (5 and 6); and FIG. 5 shows how the vee-bottom, with its constant deadrise of about 14 degrees dihedral, narrows in going aft to the transom (3), as the hull sides gradually toe in and the chines converge toward the longitudinal centerline or keel (2). FIGS. 4 and 5 also show clearly how the chine, marking the joint between bottom and hull sides, gradually "soften" in going forward to the point of disappearing as they reach the stem but become sharp-cornered or "hard" where they define the planing surfaces aft.

The fullness of the forefoot that adds buoyancy forward is also evident in the rounded development of the bottom sections of the forebody shown in FIG. 4. The shape of the transom (3), as seen from aft in FIG. 5, is the most visible change from conventional hull form, showing neither a stern post nor a square stern of other vessels. More significantly, being wide at the deck but narrowed at the waterline, it indicates a bottom having planing surfaces reduced to at least half-breadth in breadth at the stern.

Two sets of lines that further help delineate the shape of the hull bottom are usually a number of buttocks lines and several waterlines, marking the intersections where evenly spaced vertical and horizontal planes pass lengthwise through the hull. Both sets of lines indicate relative speed or the ease with which a vessel moves through the water. In the profile and plan view drawings (FIGS. 2 and 3), a typical buttocks line (9) and the designed waterline (4) show the advantage of a fairly streamlined contour where they cross the chines forward with a minimum of "knuckle" or sharp angle for least disturbance of water as the vessel moves ahead. Good seakeeping is evident in the streamlining of the waterline forward and aft, and planing speed is indicated by the parallel buttocks line where it runs straight aft to the transom.

Figure 1:
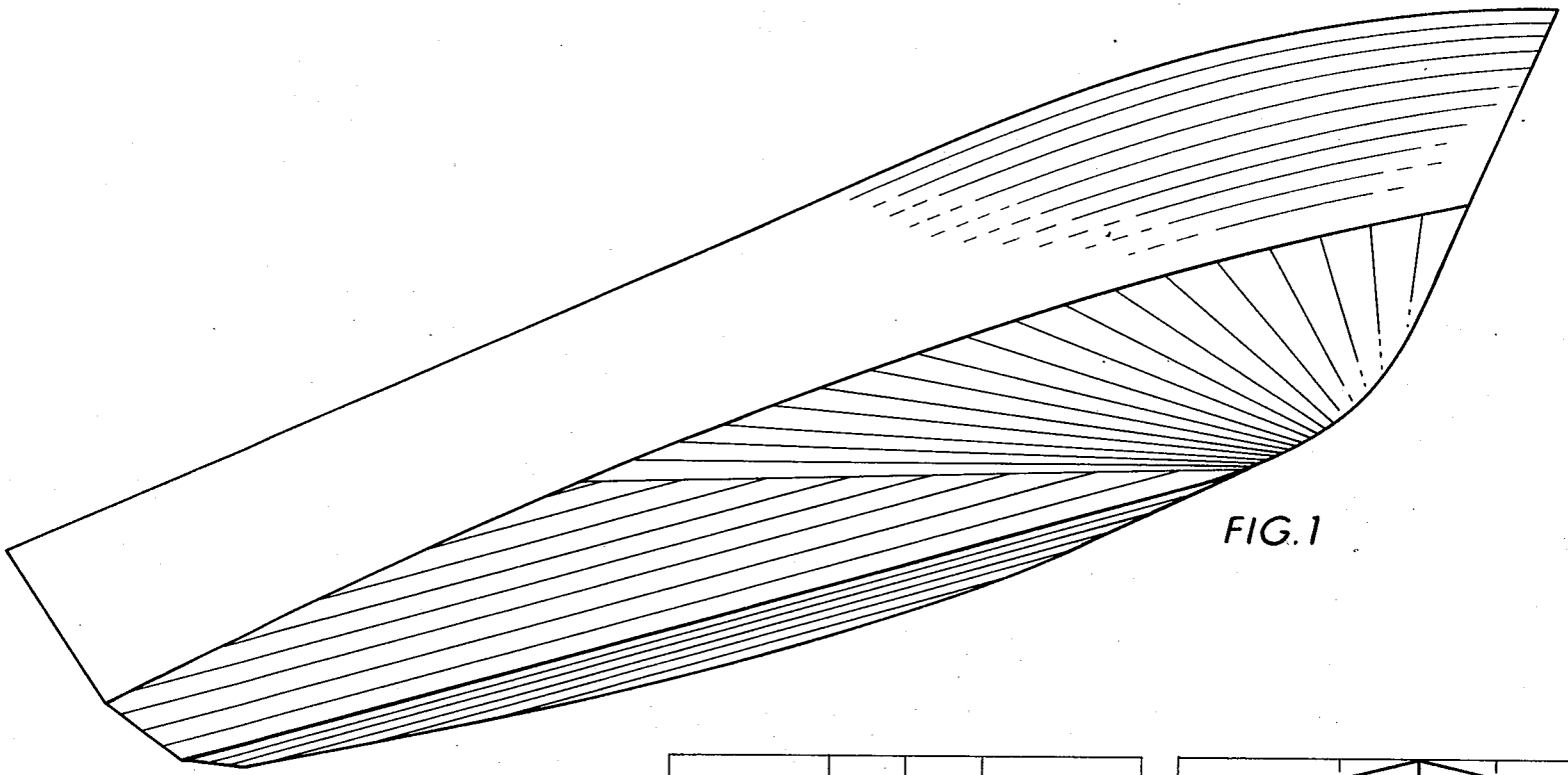
FIG. 1 is a perspective view of the hull from below the bottom.

FIG. 1 shows best how the hull bottom distinctly differs from that of a conventional transom-type planing hull, and how the converging chines affect performance. A simple analysis of the hydrodynamics involved makes it easy to see from the drawings how a real improvement in planing hull balance means better seakeeping with speed. Having the vital centers of volume, weight, and lift moved from the extreme after end of the vessel to a point nearly amidships, the fulcrum of response to wave action has also been moved forward about half of the vessel's length. Because the vessel then pivots on her midsection, the successive up and down movement of the bow and the force of impact in reaction to waves can be visualized as reduced by about one half. The planning hull with bottom or underbody configuration includes a forefoot, a midsection, and an after portion. The forefoot has conically developed surfaces in convex forward sections that provide a sharp entry to part waves in laminar flow with sufficient fullness under the bow to cushion the impact of oncoming waves and add approximately ten percent buoyancy forward to thereby effectively move the center of overall buoyancy forward. Buttocks lines and waterlines cross the chines forward with minimum knuckle to result in more streamlined form, whereby bow wave resistance is lowered by a better forebody presentation.

The midsection has vee-bottom planing surfaces beginning in a triangle forward with greatest breadth at its base amidships from which the surfaces begin to narrow between the chines that curve continuously inward toward the keel in going aft. The planing surfaces follow a straight and level keel line that begins at a point about one-eight of the load waterline length aft of the stem and runs all the way to the stern. The planing surfaces are in a moderate vee-bottom of about fourteen degrees constant deadrise. The planing surfaces join the conic surfaces forward along lines that slant out and aft at an angle of about twenty degrees to either side of the keel to reach the chines at amidships. The midsection planing surfaces taper forward and decrease aft and have the center of their total area practically amidships to provide a mid-planing hydro-dynamic lift.

The after portion has planing surfaces that continue to decrease in width between the chines converging aft to at least half of their amidships distance apart to provide no more than trailing edges at the transom for fore and aft trim. The underbody aft approaches streamlined form in the waterlines that converge with the chines as they go aft, resulting in a lower wake due to less wave-making resistance from afterbody drag. The aft underbody has buttocks lines running aft between the chines parallel to the keel and straight to the transom to maximize planing. The converging chines reduce the area of the after planing surfaces by about twenty percent, thereby lessening frictional resistance due to wetted surface. The converging chines also reduce the aft underbody volume by approximately ten percent, effectively moving the center of overall buoyance further forward to approximately amidships. The trailing edges of the planing surface at the semitransom have a span that is not more than half of the maximum beam of the planing surfaces amidships.

The average hull for an eighty-foot planing hull has a ratio of load waterline length to load waterline beam of about 4:1. This ratio would normally be higher for a larger vessel and lower for a smaller craft, maximum beam being amidships.

The vital centers of buoyancy, gravity, and lift practically coincide amidships of the hull to provide an exceptional balance that locates the axis of response to waves in the midsection, thereby reducing the violence of impact in pitching or pounding by nearly half while maintaining planing speed in a seaway.

What is claimed is:

1. A planing hull with bottom or underbody configuration comprising a forefoot, a midsection, and an after portion; the forefoot has conically developed surfaces in convex forward sections that provide a sharp entry to part waves in laminar flow with sufficient fullness under the bow to cushion the impact of oncoming waves; the midsection has vee-bottom planing surfaces beginning in a triangle forward with greatest breadth at its base amidships from which the surfaces begin to narrow between chines that curve continuously inward toward the keel in going aft; the after portion has planing surfaces that continue to decrease in width between the chines converging aft to at least half of their amidships distance apart to provide no more than trailing edges at the transom for fore and aft trim; and the centers of buoyancy, gravity, and lift that practically coincide amidships to provide an exceptional balance that locates the axis of response of waves in the midsection.

2. The planing hull of claim 1, wherein the planing surfaces of the midsection follow a straight and level keel line that begins at a point about one-eighth of the load waterline length aft of the stem and runs all the way to the stern.

3. The planing hull of claim 2, wherein buttocks lines run aft between the chines parallel to the keel and straight to the transom.

4. The planing hull of claim 1, wherein the midsection planing surfaces taper forward and decrease aft and have the center of their total area practically amidships to provide a midplaning hydrodynamic lift.

5. The planing hull of claim 1, wherein the converging chines reduce the aft underbody volume to effectively move the center of overall buoyance in part to approximately amidships.

6. The planing hull of claim 1, wherein the ratio of load waterline length to load waterline beam may vary from 3:1 to 7:1, with the ratio higher for a larger vessel and lower for a smaller craft, maximum beam being amidships.

* * * * *